United States Patent [19]

Hippo et al.

[11] Patent Number: 4,879,021

[45] Date of Patent: Nov. 7, 1989

[54] HYDROGENATION OF COAL AND SUBSEQUENT LIQUEFACTION OF HYDROGENATED UNDISSOLVED COAL

[75] Inventors: Edwin J. Hippo, Makanda, Ill.; Alfred G. Comolli, Yardley, Pa.; Robert O'Brien, Jackson, N.J.

[73] Assignee: HRI, Inc., Lawrenceville, N.J.

[21] Appl. No.: 237,636

[22] Filed: Aug. 26, 1988

Related U.S. Application Data

[63] Continuation of Ser. No. 33,856, Apr. 6, 1987, abandoned, which is a continuation of Ser. No. 874,886, Jun. 16, 1986, abandoned, which is a continuation of Ser. No. 472,915, Mar. 7, 1983, abandoned.

[51] Int. Cl.[4] ..... C10G 1/00; C10G 1/06

[52] U.S. Cl. ..... 208/413; 208/415; 208/416; 208/421

[58] Field of Search ..... 208/413, 415, 416, 421, 208/422, 409

[56] References Cited

U.S. PATENT DOCUMENTS

| | | | |
|---|---|---|---|
| 3,488,279 | 1/1970 | Schulman | 208/10 |
| 3,519,555 | 7/1970 | Keith et al. | 208/10 |
| 3,640,816 | 2/1972 | Bull et al. | 208/10 |
| 3,679,573 | 7/1972 | Johnson | 208/10 |
| 3,700,584 | 10/1972 | Johanson et al. | 208/10 |
| 3,791,957 | 2/1974 | Wolk | 208/10 |
| 4,090,943 | 5/1978 | Moll et al. | 208/10 |
| 4,102,775 | 7/1978 | Quarderer et al. | 208/10 |
| 4,111,788 | 9/1978 | Chervenak et al. | 208/10 |
| 4,123,347 | 10/1978 | Maa | 208/10 X |
| 4,189,371 | 2/1980 | Maa et al. | 208/10 X |
| 4,298,454 | 11/1981 | Aldridge et al. | 208/108 X |
| 4,316,792 | 2/1982 | Sze | 208/10 |
| 4,331,530 | 5/1982 | Qader | 208/10 |
| 4,338,184 | 7/1982 | Maa et al. | 208/10 |
| 4,345,989 | 8/1982 | Vernon et al. | 208/10 |
| 4,364,817 | 12/1982 | Anderson et al. | 208/10 X |
| 4,428,820 | 1/1984 | Kuehler et al. | 208/10 |

*Primary Examiner*—Glenn Caldarola

*Attorney, Agent, or Firm*—Fred A. Wilson

[57] ABSTRACT

A process for the hydrogenation of undissolved coal and subsequent liquefaction of the hydrogenated coal particles to provide useful hydrocarbon liquid products including naphtha, gasoline and diesel fuel. These low boiling hydrocarbon liquids are produced by the process comprising: (a) mixing solid coal particles with a coal derived solvent in a solvent/coal ratio ranging from about 8/1 to about 1.5/1 to provide a flowable coal/oil slurry of solid coal particles; (b) passing the coal/oil slurry and hydrogen upwardly through a first reaction zone containing a coal-derived liquid and bed of particulate catalyst maintained at a temperature ranging from about 400° to about 700° F. and a hydrogen partial pressure of 100 to 2000 psig for a time sufficient to hydrogenate the solid coal particles; and (c) withdrawing the coal/oil slurry having the hydrogenated coal particles from the first reaction zone and passing the coal/oil slurry to a second reaction zone containing a catalytic bed which is maintained at a temperature of between about 700° and about 850° F. and a hydrogen partial pressure of 9 to 2000 psig to liquefy and convert the coal to useful hydrocarbon liquid fuel products. The first and second reaction zones may include the same or different catalysts such as Co/Mo on a porous substrate, or the second reaction zone can include a noble metal such as platinum on a porous substrate such as alumina or silica.

17 Claims, 4 Drawing Sheets

*THF-TETRAHYDROFURAN

HYDROGENATION OF COAL AND SUBSEQUENT LIQUEFACTION OF HYDROGENATED UNDISSOLVED COAL

This application is a continuation of application Ser. No. 033,856; filed Apr. 6, 1987, which is a continuation of Ser. No. 874,886 filed June 16, 1986, which is a continuation of Ser. No. 472,915 filed Mar. 7, 1983 all now abandoned.

BACKGROUND OF INVENTION

This invention relates to a coal liquefaction process, and more particularly, it relates to the hydrogenation of undissolved coal hydrogenation and and subsequent liquefaction thereof to provide useful hydrocarbon liquid and gas fuel products wherein solid coal particulates are hydrogenated in a coal/oil slurry of a hydrocarbon liquid solvent in the presence of a particles hydrogenation catalyst.

Conventional processes for coal liquefaction and hydrogenation include a preheating or thermal dissolution step for the coal-oil slurry feed prior to the catalyst reaction step, as generally disclosed in U.S. Pat. No. 3,519,555; 3,700,584; 3,791,957 and 4,111,788. Other coal hydrogenation processes use fine recycled catalysts at plug flow conditions and low solvent/coal ratios such as U.S. Pat. Nos. 4,090,943 and 4,102,775. In these processes, the coal-oil slurry is preheated to near the reactant temperature before feeding it into the catalytic reaction zone.

In these conventional coal hydrogenation processes which utilize the coal-slurry preheating step, the hydrogen donor potential or hydrogen concentration of the coal-derived slurrying oil therein is limited by its mobility and the hydrogen is usually consumed during the coal preheating and dissolution steps. These processes are also lacking in that the coal is not sufficiently hydrogenated to fully liquefy or convert coal to useful hydrocarbon liquids and gas fuel products as provided herein.

The conventional methods of coal liquefaction attempt to liquefy coal while having donatable hydrogen available in the solvent liquid to "seal off" free radicals which crack from the coal. Catalytic processes provide a greater quantity of hydrogen for this purpose by hydrogenating the solvent. In significant contrasts, the process of the present invention relies on substantial hydrogenation of the particulate coal in the first stage, particle but the predominant transfer of the donatable hydrogen to the coal particle takes place before the liquefaction thereof. Once the coal liquefies, the excess hydrogen in the products induces almost immediate reformation reactions which in turn result in stable, light compounds. In hydrocarbon the conventional liquefaction processes, more heavy residual products are made since the polymerization reactions, i.e., condensation, are competitive with the hydrogen transfer from solvent reformation reactions which occur much slower.

In a process developed by Qader and described in U.S. Pat. No. 4,331,530, a process for the hydrogenation of coal and subsequent treatment of hydrogenated coal to produce fuels and chemicals is provided. In this process, there is not any solvent used and the hydrogen provided in the process involves the hydrogen transfer from the gas phase to solid phase. In an attempt to hydrogenate the coal, the coal has been pulverized into very fine particles. This procedure of hydrogenating a dry coal, provides great difficulty in the hydrogenation thereof in order to liquefy or convert such coal to useful fuel products. Thus; the present coal hydrogenation and liquefaction process is needed in order to fully and more completely convert the hydrogenated coal of various types to useful low boiling hydrocarbons liquids and fuel products such as gasoline, diesel fuel oil, and naphtha.

SUMMARY OF INVENTION

The present invention provides a process for the two stage hydrogenation of particulate coal and the subsequent liquefaction thereof to provide useful hydrocarbon liquid and fuel products. The process comprises:

(a) mixing solid coal particles with a hydrocarbon liquid solvent in a solvent/coal weight ratio at least sufficient to provide a flowable coal/oil slurry of the solid coal particles;

(b) passing the coal/oil slurry and hydrogen upwardly through a first reaction zone containing a hydrocarbon liquid in a catalytic bed of particulate hydrogenation catalyst maintained at a temperature ranging from about 400° to about 700° F. and a hydrogen partial pressure of 100 to 2000 psig for a period of time sufficient to substantially hydrogenate the solid coal particles and liquid solvent in the coal/oil slurry;

(c) withdrawing the coal/oil slurry having the hydrogenated coal particles from the first reaction zone and passing the coal/oil slurry to a second reaction zone containing a catalytic bed of particulate hydrogenation catalyst which is maintained at a higher temperature between about 700° and about 850° F., and a hydrogen partial pressure of 0 to 2000 psig to convert the hydrogenated coal particles to gas and liquid fractions;

(d) passing the liquid fractions from the second reaction zone to a gas liquid, solid separation zone from which a liquid stream containing a reduced solids concentration is recycled to provide a hydrogenated coal-derived solvent liquid for the coal/oil slurry; and (e) recovering from the separation zone hydrocarbon liquid distillate and gaseous hydrocarbon products.

In the process, the nominal residence time of the materials in the first reaction zone ranges from about 5 to about 90 minutes and the residence time in the second reaction zone ranges from about 1 to about 90 minutes.

BRIEF DESCRIPTION OF THE DRAWINGS

This invention can best be understood by reference to the FIG. 1 drawing which is a schematic diagram of the present continuous two stage process of the hydrogenation/liquefaction of coal, wherein the hydrogenation reactor, liquefaction/conversion reactor, separation-purification systems and recycle conduits are shown.

DESCRIPTION OF INVENTION

Figure 1:
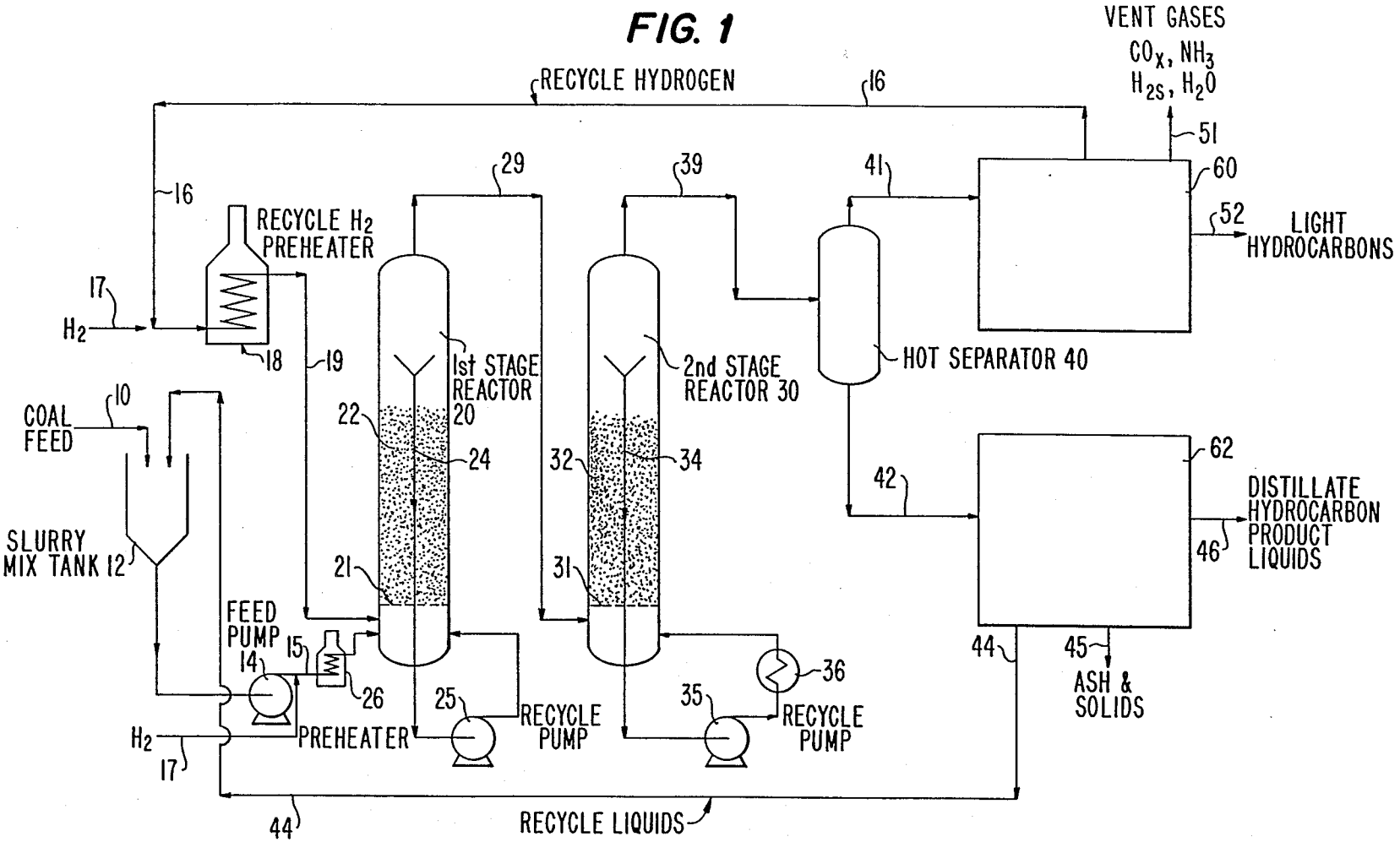

The present process of hydrogenating coal particles and subsequently liquefying such hydrogenated particles to provide useful products involves the operation of two close-coupled catalytic bed reactors, i.e., first and second reaction zones. In the first reaction zone, the conditions are designed to promote the hydrogenation of the coal particles and to effect most of the heteroatom removal to by-products such as hydrogen sulfide, ammonia and water. In the second reaction zone, the conditions are maintained sufficient for the conversion/liquefaction of the hydrogenated coal to hydrocarbon convert it readily to liquid products while removing still more of the heteroatoms, e.g., hydrogen sulfide, ammonia and water.

According to the present invention, coal is hydrogenated prior to liquefaction in a system capable of providing usable hydrogen to sites within the solid coal matrix directly and also through the hydrogenated solvent oil. The process according to the present invention involves a well mixed catalytic first stage reaction zone in which a slurry of coal and hydrocarbon solvent is present with any suitable hydrogenation catalyst under increased temperature and hydrogen pressure. A suitable catalyst would be a cobalt/molybdenum catalyst on a substrate of alumina. According to the present invention, there is no limitation as to the hydrogenation catalyst used in the process. That is, any catalyst may be used providing it will promote the hydrogenation of solid coal particles. Also, the catalysts would be heterogenous and can be supported on any porous substrate, e.g., alumina or silica or mixtures thereof. The catalysts used in the beds of the first and second reaction zones may be a particulate catalyst having a substrate containing an active metal or metal compound selected from the group consisting of: Co/Mo; Ni/Mo; LiW or Sn promoted Co/Mo; NiS; CoS; MoS; FeS; $FeS_2$; LiH; and $MgH_2$. Also, the catalyst used in the first and second reaction zones may be a noble metal such as platinum. More specifically, the catalyst may be a substrate material containing an active metal or metal compound selected from the group consisting of: metals of Group VIII of the Periodic Table, and their salts; tin; zinc; copper; chromium; and antimony. The catalyst may be the same in both the first and second reaction zones but this is not necessarily the preferred mode of operation.

The coal that is fed into this process and catalytically hydrogenated before it is liquefied may be any bituminous coal, such as Illinois No. 6 or Kentucky No. 11, or a subbituminous coal such as Wyodak. The feed material may also be lignite, or peat. In each case, the type of coal or coal/oil feedstock used will dictate the conditions required in the first and second reaction zones.

In the process, hydrogen is provided initially to the catalytic reaction to start up the process but during the course of the continuous two stage operation, hydrogen is recovered from the process and recycled to be fed into the first reaction zone to hydrogenate the feedstock, i.e., coal particles and hydrocarbon slurrying oil. During the process, a sufficient amount of hydrogen is provided in order to fully hydrogenate the coal feed so that it may be liquefied or converted easily at the higher temperature within the second reaction zone. Under normal conditions, the amount of hydrogen consumed or utilized in the first reaction zone, based on the weight of dry coal fed therein is between about 2.0 and about 4.0 W %. This amount of hydrogen may vary as based on the type of coal feed that is utilized in the present process.

The coal-derived solvent used to make up the coal/oil slurry may be any suitable coal-derived hydrocarbon liquid material wherein a substantial portion thereof has a normal boiling point ranging from about 400° F. to about 1100° F. Of this coal-derived liquid material i.e., solvent, at least about 50% has a normal boiling point above about 975° F.

According to the present invention, it has been found that a suitable hydrocarbon liquid solvent utilized in the coal/oil slurry may be selected from the group consisting of petroleum-derived residual oil, shale oil, tar sands, bitumen and an oil derived from coal other than that processed within the present process. The solvent oil is catalytically hydrogenated internally in the first reaction zone and migrates into the pore structure of the solid coal particles. Where the solvent gives up hydrogen to the coal particle matrix. The hydrogenated solvent molecules do this repeatedly until an equilibrium hydrogen content is achieved in the coal particles and coal/oil slurry.

In the first reaction zone, the coal is fed with hydrogen and through the first reaction zone into the catalytic bed, where the catalytic bed is maintained at a temperature ranging from about 400° to about 700° F. and a hydrogen partial pressure of 100 to 2000 psig with the total pressure being between about 100 and 4000 psig, and preferably ranging between about 1000 and about 3000 psig. The residence time of the materials in the first reaction zone ranges from about 5 to about 90 minutes, which is sufficient to hydrogenate the solid coal particles and the hydrocarbon solvent liquid in the coal/oil slurry.

After the coal solid particles have been hydrogenated in the first reaction zone, the coal/oil slurry is introduced into the second reaction zone where liquefaction of the coal occurs at higher temperature. The conditions in the second reaction zone are near to but less severe than the conditions for the conventional liquefaction of coal. Since the coal structures are weakened by the hydrogenation of the matrix, less thermal energy will be required to liquefy the coal in the second reaction zone since an excess of hydrogen exists in the solid phase of the coal; as well, a lower hydrogen partial pressure will still provide sufficient gas phase hydrogen to terminate free radicals of liquefaction products. The end result is to produce lighter or lower boiling hydrocarbon liquid products (i.e., distillate oil and naphtha) with less severe reaction conditions being required relative to the conventional coal liquefaction process. The temperature of the second reaction zone ranges from about 700° to about 850° F. and the hydrogen partial pressure ranges from about 0 to about 2000 psig with the total pressure being between about 500 and about 4000 psig and preferably ranging between about 1500 and about 2500 psig. The residence time of the materials in second reaction zone ranges from about 1 to about 90 minutes.

Although the second reaction zone is preferably a catalytic reaction zone, it may instead be a non-catalytic back mixed thermal reaction zone.

The coal particles fed to the present process have a particle size ranging from about 20 mesh to about 400 mesh (U.S. Sieve Series), and preferably from about 70 mesh to about 100 mesh (U.S. Sieve Series).

The products of the two stage hydrogenation and conversion process generally are distillate liquid hydrocarbon products such as naphtha, gasoline and diesel fuel and insoluble materials and ash are removed from the process.

According to the present invention, the product yields as provided by the prehydrogenation of the coal before it is liquefied results in the advantages of:

(a) the need for less severe conditions in the conversion/liquefaction reaction zones; and (b) an increase in the yield or production of the products, i.e., hydrocarbon liquid distillate and products.

According to the present invention and as indicated and discussed below in the Examples, by use of the present invention, an increase in product yields will average from between at least about 5 and about 24% over that resulting from a conventional coal liquefaction process or single stage catalytic hydrogenation process. The yields from the present process of hydrocarbon liquid material such as cyclohexane solubles ranges from about 60 to about 90 W% of the coal feed.

DESCRIPTION OF PREFERRED EMBODIMENT

Referring to the FIG. 1 drawing, a continuous two-stage coal liquefaction process is schematically shown. As shown, a coal feed or feedstock is provided at 10. The coal being, e.g., an Illinois No. 6 coal or other bituminous coal, is ground to a particle size of about 70 mesh (U.S. Sieve Series) and smaller and dried to remove surface moisture and passed to a slurry mix tank 12. Here the particulate coal is blended with a process derived oil or an oil derived from coal in other than the process herein. The process derived oil or solvent is blended in at weight ratio of solvent to coal which is at least sufficient to provide a pumpable slurry mixture, and usually has a weight ratio range of solvent to coal ranging from about 8/1 to about 1.5/1.

The coal/oil slurry, i.e., blend from slurry mixing tank 12, is pressurized by pump 14, heated in feed preheater 26 and pumped through conduit 15 to blend along with make-up hydrogen through conduit 17 directly to an ebullated bed reactor 20 containing hydrogenated coal-derived liquid, the hydrogen and a bed 22 of particulate hydrogenation catalyst. The coal/oil slurry is passed with hydrogen through flow distributor grid plate 21 and upwardly through the catalyst ebullated bed 22 at sufficient velocity to expand the bed. The catalyst 22, which suitably may comprise particles such as 0.030–0.130 inch diameter extrudates of nickel/-molybdate or cobalt/molybdate on alumina or a similar support material, is expanded by at least about 20% and not over about 100% of its settled height by the upflowing fluids, and is kept in constant random motion during reaction by the upward velocity of the coal/oil slurry and hydrogen gas.

The coal/oil slurry is passed upwardly through reactor 20 and in contact with the catalyst at average nominal residence times ranging from about 5.0 to about 90 minutes, and preferably from about 10 to about 30 minutes. The reaction conditions maintained within the first reaction zone 20 are a temperature of 400° to 700°; preferably 550° to about 650° F., and a 100–2000 psig hydrogen partial pressure, or a total pressure of between about 100 and 4000 psig, preferably ranging from about 1000 to about 3000 psig. The reactor liquid is recycled through a downcomer conduit 24 and recycle pump 25 and then passed upwardly through the distributor plate 21 to maintain sufficient upward liquid velocity to expand the catalyst bed and maintain the catalyst at random motion in the liquid to assure intimate contact with complete reactions to substantially hydrogenate the coal particles both directly and through the hydrocarbon solvent liquid therein.

From the first stage reactor 20 effluent stream 29 containing, the hydrogenated coal particles in the coal-/oil slurry is passed into the bottom of the second stage reactor 30. The hydrogenated coal is then passed through a flow distributor and catalyst support grid plate 31 into an ebullated bed 32 of catalyst, in much the same way as the material flows through first stage reactor 20. The hydrogenated coal/oil slurry is passed upwardly through the reactor 30 in contact with the catalyst at nominal average residence times of about 1.0 to about 90 minutes, and preferably from about 10 to about 30 minutes. The reaction conditions maintained in the second stage reactor 30 are a higher temperature ranging from about 700° to about 850° F., preferably about 800° to about 825° F., and a 0–2000 psig hydrogen partial pressure, or a total pressure of between about 500 and about 4000 psig, preferably ranging from about 1500 to about 2500 psig. The reactor liquid in the second reactor 30 is recycled through downcomer conduit 34 and recycle pump 35 to heat exchanger 36 for heating and controlling the temperature of the reaction liquid of the second reactor 30 within a relatively narrow range. The reactor liquid is then passed upwardly through distributor plate 31 to maintain sufficient mixing and upward liquid velocity to expand the catalyst abullated bed and maintain the catalyst in random motion in the liquid to assure intimate contact and complete reactions therein.

From the second reactor 30 effluent stream 39 containing, the reaction liquid, i.e., liquefied coal and gaseous materials, is usually cooled and passed to hot separator 40. The resulting vapors are passed through conduit 41 and may be processed in a first separation-purification system 60 as desired to obtain recovered low purity hydrogen, which is recycled through conduit 16 to preheater 18 and then into the bottom of reactor 20. Other light gases such as hydrogen sulfide, $NH_3$, and $CO_x$ are emitted from purification system 60 through conduit 51; and product gases, i.e., low boiling, light hydrocarbon gases are emitted from system 60 through conduit 52.

From the bottom of the hot phase separator 40, a coal-derived slurry liquid is withdrawn through conduit 42. The slurry liquids in conduits 42 are processed in a second separation-purification system 62 to obtain a recycle liquid or slurry containing a reduced solids concentration which is passed through conduit 44 without additional or separate hydrogenation to the slurry mix tank 12. The coal-derived liquid solvent recycled through conduit 44 has a normal boiling point ranging from about 400° F. to about 1100° F., with at least about 50 W% of the solvent material having a normal boiling point above about 975° F. Also, the slurry liquid from conduit 42 is processed in the second system 62 as desired to remove ash and insoluble materials through conduit 45, and to remove product liquids, i.e., distillate hydrocarbon liquids, through conduit 46.

The recovered hydrogen is recycled into the process through conduit 16 to preheater 18, where it is heated prior to being passed through conduit 19 into the bottom of the first reactor 20. This arrangement including make-up hydrogen at 17 as needed provides the hydrogen needed in the continuous process of the present invention.

The present invention and its advantages are further illustrated by the following examples, which are not intended to be limiting for the scope of the invention.

EXAMPLE 1

Present and Single Stage Coal Liquefaction Processes

In order to show the effectiveness of the present process, a comparison was made between the present process and a single stage H-Coal ®, coal liquefaction process. The conditions and process yield results of the two processes are provided below in Table 1. In both cases, Illinois No. 6 coal from Burning Star mine and known to be relatively difficult to liquefy, was processed and liquefied.

TABLE 1

Comparison of Continuous Process Results For Burning Star Illinois No. 6 Coal

| | Present Process | H-Coal ® |
|---|---|---|
| Reaction Conditions | | |
| 1st stage temperature, °F. | 550 | |
| 1st stage reaction time, min. | 30 | |
| 1st stage $H_2$ pressure, psig | 2000 | |
| 2nd stage temperature, °F. | 800 | 850 |
| 2nd stage reaction time, min. | 30 | 30 |
| 2nd stage $H_2$ pressure, psig | 2000 | 2250 |
| YIELDS, W % Dry Coal | | |
| $C_1$–$C_3$ Gas | 7.2 | 9.9 |
| $C_4$–400° F. Liquid | 15.4 | 19.8 |
| 400–650° F. Liquid | 19.8 | 18.6 |
| 650–975° F. Liquid | 21.1 | 10.0 |
| 975° F.+ Material | 11.8 | 19.5 |
| Total $C_4$–975° F. Liquid | 56.3 | 48.4 |
| Hydrogen Consumption | 4.6 | 5.2 |
| Coal Conversion | 93.0* | 94.0 |
| $H_2O$, $H_2S$, $NH_3$, etc. | 13.0 | 9.9 |
| Ash | 11.8 | 11.5 |

*Not Optimized

As shown in Table 1 above, the present process yields less hydrocarbon gas, more distillate liquid, less 975° F.+ bottoms fractions, more heteroatom gases, and consumes less hydrogen than in the single reaction stage H-Coal process. These results, as shown in Table 1, were obtained at a lower maximum temperature and hydrogen partial pressure for the present process than those employed in the conventional H-Coal process.

The results listed in Tables 1, 2 and 3 are for approximately the same catalyst age. Table 2, below, shows a further comparison between the present process and a single stage H-Coal process operated at the conditions listed in Table 1. These results show that there is less heteroatom sulfur and nitrogen compounds in the products i.e., product fractions from the present process than in the products from the conventional single stage H-Coal process. The advantages of the present process over the single stage H-Coal process, which were operated at the conditions listed above in Table 1, are shown below in Table 3. The higher $C_4$-975° F. distillate yields and lower hydrogen consumptions result in a much higher hydrogen efficiency for the present process as compared to the single stage H-Coal process.

TABLE 2

Comparative Heteroatom Removal For Single Stage Vs. Two Stage Catalytic-Catalytic Process

| | H-Coal ® | Present Process |
|---|---|---|
| Sulfur, in Products W % | | |
| $C_4$–400° F. | 0.04 | 0.05 |
| 400–650° F. | 0.05 | 0.03 |
| 650–975° F. | 0.18 | 0.05 |
| Nitrogen, in Products W % | | |
| $C_4$–400° F. | 0.16 | 0.09 |
| 400–650° F. | 0.55 | 0.19 |
| 650–975° F. | 0.97 | 0.60 |

TABLE 3

Process Efficiency

| | H-Coal ® | Present Process |
|---|---|---|
| $C_4$–975° F. Yields As W % of Dry Coal | 47 | 56 |
| Hydrogen Efficiency Expressed As Ratio of $C_4$–975° F. yield Total Hydrogen Consumed | 9.6 | 12.2 |

EXAMPLE 2

Present and Two Stage Thermal/Catalytic Liquefaction Processes

In order to further illustrate the effectiveness of the present process, a comparison was made between the present process and a two stage thermal/catalytic liquefaction process. The operating parameters and yields for the present process and the thermal/catalytic two stage process are provided below in Table 4. In both cases, Burning Star, Illinois No. 6 coal was processed and liquefied. The results of Table 4 are for a comparable catalyst age.

TABLE 4

Comparison of Continuous Process Results For Burning Star Illinois No. 6 Coal

| | Present Process | Thermal/ Catalytic Two-Stage |
|---|---|---|
| Reaction Conditions | | |
| 1st stage temperature, °F. | 550 | 850 |
| 1st stage reaction time, min. | 30 | 30 |
| 1st stage $H_2$ pressure, psig | 2000 | 2250 |
| 2nd stage temperature, °F. | 800 | 770 |
| 2nd stage reaction time, min. | 30 | 30 |
| 2nd stage $H_2$ pressure, psig | 2000 | 2250 |
| Yields, W % Dry Coal | | |
| $C_1$–$C_3$, Gas | 7.2 | 7.2 |
| $C_4$–400° F. Liquid | 15.2 | 17.4 |
| 400–975° F. | 40.9 | 34.0 |
| 975° F.+ | 11.8 | 15.8 |
| Total $C_4$–975° F. Liquid | 56.3 | 51.4 |
| Hydrogen Consumption | 4.6 | 5.1 |
| Coal Conversion | 93.0* | 94.0 |
| $H_2O$, $H_2S$, $NH_3$, etc. | 13.0 | 12.8 |
| Ash | 11.8 | 11.7 |

*Not Optimized

As shown in Table 4, equivalent gas yields and light distillates $C_4$-400° F. fractions yields are obtained, but more diesel and heavy distillate vacuum gas oil fractions are obtained from the present process than from the thermal/catalytic process. In addition, total distillate yields are increased and total 975° F.+ bottoms yields are decreased for the present process as compared to the thermal/catalytic process.

A comparison of the heteroatom contents for the various product cuts from the thermal/catalytic and present process are listed below in Table 5. These results show that the present process produces less heteroatom sulfur and nitrogen compounds in the various product cuts or fractions. The process efficiencies for coal liquefaction and hydrogen consumption for the two processes are listed below in Table 6. These results show that higher distillate yields and lower hydrogen consumption results in better process conversion product fractions hydrogen efficiency for the present process than for the thermal/catalytic process.

TABLE 5

| Comparative Heteroatom Removal For Two Stage Processes | Thermal/ Catalytic Two-Stage | Present Process |
|---|---|---|
| Sulfur, in Product Fractions W % | | |
| $C_4$–400° F. | 0.16 | 0.05 |
| 400–650° F. | 0.10 | 0.03 |
| 650–975° F. | 0.16 | 0.05 |
| Nitrogen, in Product Fractions W % | | |
| $C_4$–400° F. | 0.07 | 0.09 |
| 400–650° F. | 0.25 | 0.19 |
| 650–975° F. | 0.64 | 0.60 |

TABLE 6

| Process Efficiency Comparison | Thermal/ Catalytic Two Stage | Present Process |
|---|---|---|
| $C_4$–975° F. yield As W % of dry coal | 52 | 56 |
| Hydrogen Efficiency Expressed as ratio of $C_4$–975° F. total hydrogen consumed | 10.6 | 12.2 |

EXAMPLE 3

Comparison of Present Process With Existing Coal Liquefaction Processes

In order to show the effectiveness of the present process, a comparison was made of a run of the present process for the liquefaction of coal, with runs of existing coal liquefaction processes: H-Coal®, Chevron Coal Liquefaction (CCLP); Solvent Refined Coal I (SRC I); and SRC II. In all cases, Burning Star, Illinois No. 6 coal was processed and liquefied. The operating conditions for the various runs were similar and comparable to those for the present and H-Coal® processes, listed above in Table I of Example 1. The results and yields for the various processes are provided below in Table 7.

TABLE 7

| Fraction | Yield of Burning Star Illinois No. 6 Coal (All quantities expressed in Wt % AF coal) Present Process | H-Coal ® | CCLP* | SRC I** | SRC II** |
|---|---|---|---|---|---|
| $NH_3$, $H_2S$, $H_2O$, CO, $CO_2$ | 12 | 11 | 15 | 10 | 12 |
| $C_1$–$C_3$ Gases | 8 | 11 | 7 | 7 | 17 |
| $C_4$–400° F. | 19 | 23 | 9 | NA | 11 |
| 400–650° F. | 24 | 22 | 26 | NA | 10 |
| 650–975° F. | 26 | 12 | 29 | NA | 23 |
| $C_4$–975° F. | 69 | 56 | 64 | 12 | 44 |
| 950° F.+ | 10 | 21 | 9 | 63 | 26 |
| Unconverted Coal | 6 | 6 | 10 | 8 | 4 |
| $H_2$ Consumption | 5 | 5 | 5 | 3 | 3 |
| Total | 105 | 105 | 105 | 103 | 103 |

NA - not available

*Data is extracted from TGA results published by Chevron; Rosenthal, J.W., et al, "The Chevron Coal Liquefaction Process" EPRI Contractors' Conference, 47th midyear Mtg. May 10-13, 1982

**Data from: Elliot, M.A. ed Chemistry of Coal Utilization, 2nd supplementary Vol. 1981, John Wiley & Sons, Inc., NY, NY.

(Note: Thermogravimetric Analysis may tend to shift distillation results from high boiling point to low.)

As shown above in Table 7, the present process gives higher distillate yields of ($C_4$-975° F.) fraction than any reported process. Less 975° F.+ bottoms yield and higher hydrogen efficiency are also observed for the present process. Also, the results for the present process were obtained at lower hydrogen partial pressures than those employed in the single stage H-Coal® process.

EXAMPLE 4

Comparison of Present and H-Coal® Batch Processes

In order to further illustrate the overall effectiveness of the present process catalytic reaction, batch processes runs comparing the present two-stage process and the single stage H-Coal® process were made. The conditions and yields of both batch process runs are provided below in Table 8, which shows that appreciably higher yields of soluble hydrocarbon materials are provided by the present process.

Also, in FIG. 2 below, the effectiveness of the present process is demonstrated for the conversion of Burning Star Illinois No. 6 coal as compared to that of the single-stage H-Coal® process. The processes in both runs A and B use a standard Co/Mo catalyst, whereas in run C a different Co/Mo catalyst, i.e., AMOCAT 1A is used. The results, i.e., yield distributions, are set forth as conversion to solubles in various solvents such as cyclohexane, toluene, and tetrahydrofuran.

Figure 2:
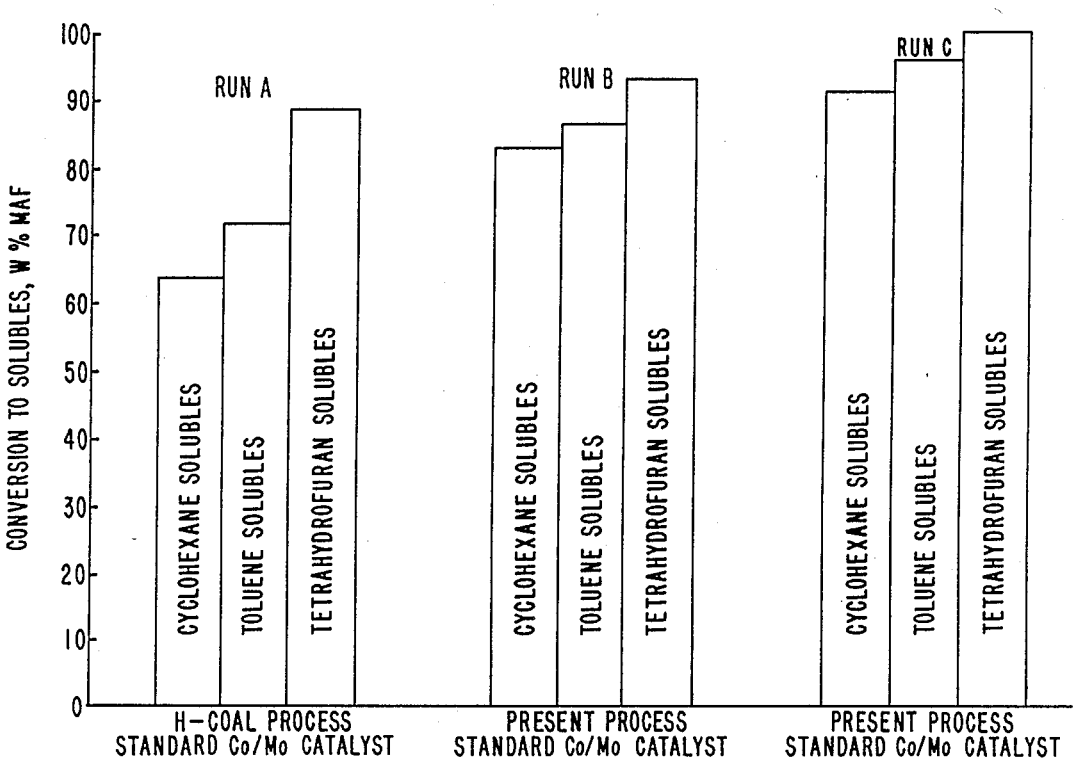
FIG. 2 is a chart showing a comparison of yield distributions of solubles for the process of the present invention.

The results provided in FIG. 2 show that for a given thermal severity in the 2nd stage reaction, the present process yields higher conversions to various solubles than does the conventional H-Coal® process at the same severity. An increase of about 20% in cyclohexane solubilities is obtained. Increases in toluene solubilities range from about 15 to about 20% and increases in tetrahydrofuran solubles (a measure of total conversion) range about 5 to 10%. Table 8 lists the yields from Illinois No. 6 Burning Star Coal in the batch tests. These results show the superiority of the present process over the H-Coal® process. The total conversions of coal for tetrahydrofuran solubles is 6% higher for the present process, for cyclohexane solubles is 23% higher for the present process, and maximum obtained toluene solubles are 20% higher in the present process than for the H-Coal ® process. The total higher percent conversion of coal for the present process, as shown in FIG. 2 are: (1) 6% higher for tetrahydrofuran solubles; (2) 23% higher for cyclohexane solubles; and (3) 20% higher for toluene solubles than for the single stage H-Coal process.

shown, the yields of solubles at for 500 pounds per square inch pressure in the present two-stage process conducted at 550° F. in the first stage for a 30 minute residence time, and 800° F. and 30 minutes residence time in the second stage, are greater than those obtained for the single stage H-Coal ® processing at 500 psig hydrogen partial pressure, 800° F. temperature and 60 minutes residence time. Thus, it follows that the present

TABLE 8

| Maximum Comparative Yields for Illinois No. 6 Coal in Batch Tests | | |
|---|---|---|
| | H-Coal ® Process | Present Process |
| Yields, W % MAF | | |
| Cyclohexane Solubles | 67 | 90 |
| Toluene Solubles | 73 | 93 |
| Tetrahydrofuran Solubles | 90 | 96 |
| Reaction Conditions | | |
| 1st Stage Temperature, °F. | — | 550 |
| 1st Stage Time min. | — | 60 |
| 1st Stage Pressure, psi | — | 2000 |
| 2nd Stage Temperature, °F. | 830 | 800 |
| 2nd Stage Time min. | 30 | 60 |
| 2nd Stage Pressure, psi | 2000 | 2000 |

FIG. 2
COMPARISON OF YIELD DISTRIBUTIONS
OF SOLUBLES FOR H-COAL ® AND PRESENT PROCESS

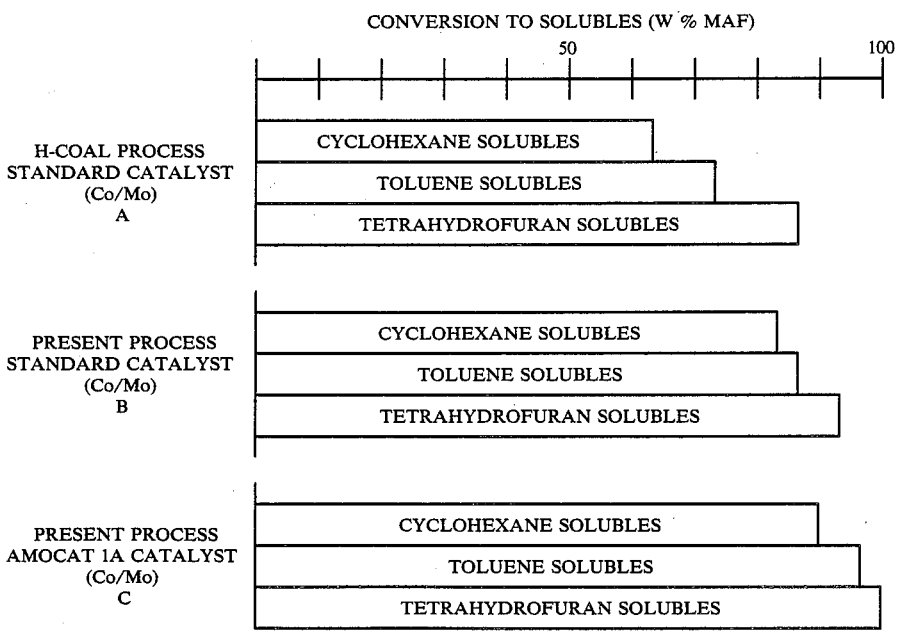

Figure 3:
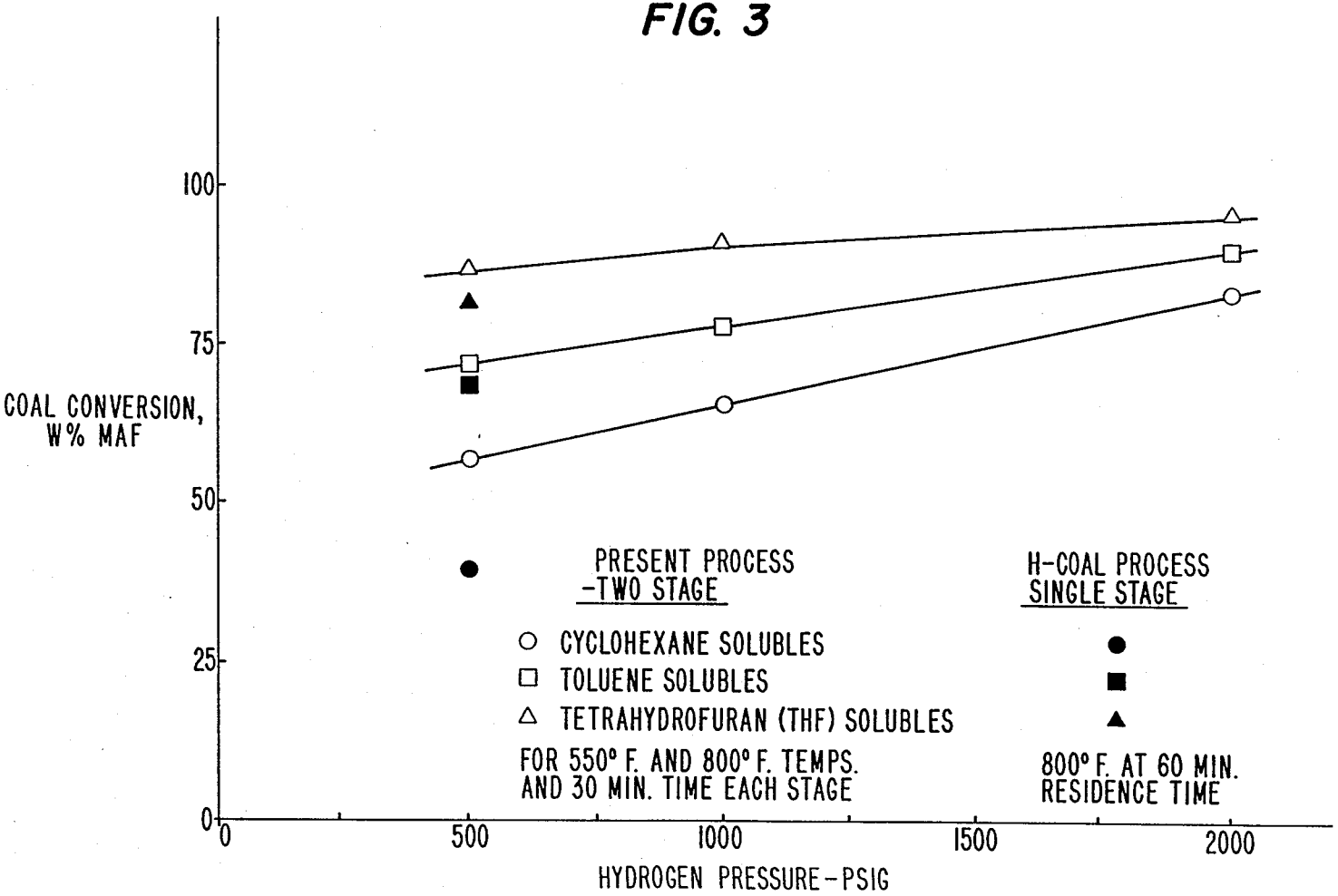
FIG. 3 is a graph showing the effect of hydrogen pressure on percent coal conversion.

In FIG. 3, below, the effect of pressure on the present process is illustrated. Batch runs were made on Illinois No. 6 coal with cobalt/molybdenum catalyst at hydrogen partial pressure of 500, 1,000, and 2,000 psig. As process can be operated at lower pressures than the conventional single-stage H-Coal ® process and still obtain higher yields of desired hydrocarbon liquids.

FIG. 3
Effect of Pressure on Present Process

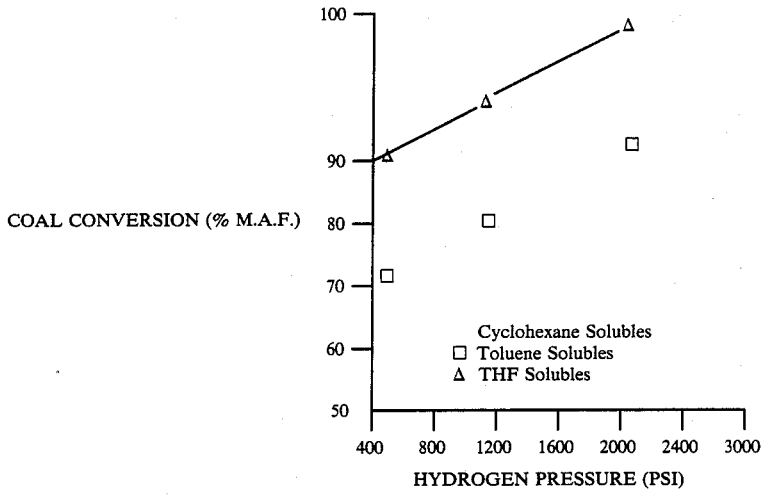

EXAMPLE 5

Present and H-Coal ® Processes For Conversion of Various Coals

In order to show the effectiveness of the present process for processing different coals, runs were made using the present process and the conventional single stage H-Coal ® process for both Burning Star, Illinois No. 6 coal and a low volatile coal. The operating conditions for both the present and H-Coal ® processes were the same as those listed above in Table I of Example 1. The results of these tests are illustrated below in FIG. 4, and are presented on a conversion to various solubles bases, i.e., conversion to cyclohexane solubles, toluene solubles, and tetrahydrofuran solubles. The cross-hatched bars represent equivalent second stage thermal severities for the various tests. The open bars represent the maximum obtained conversion for the individual processes.

Figure 4:
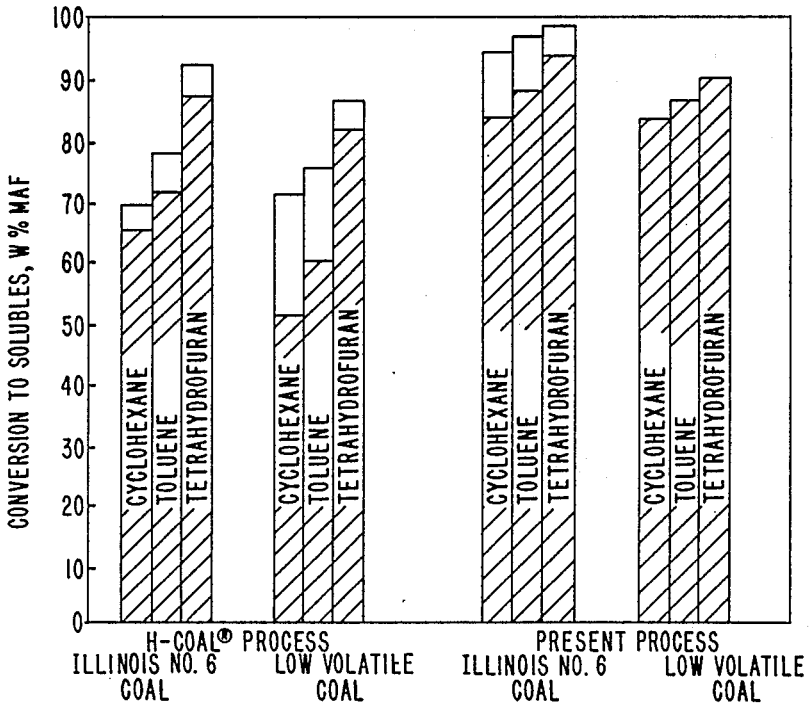
FIGS. 4 and 5 are charts showing the comparative conversion results for the present conversion process compared to other processes for bituminous and low rank coals.

In FIG. 4, no maximum conversion data is illustrated for the low volatile coal since these results represent a single data point. The data in FIG. 4 indicates that the low volatile coal is less reactive under the conventional H-Coal ® process than Illinois No. 6 Burning Star coal. On the other hand, the results for the present process show that the low volatile coal is as reactive as the Illinois No. 6 coal, and yields far more solubles than the conventional H-Coal ® process yields with this coal. Thus, in the present process, an unreactive low volatile bituminous coal is made as reactive as highly reactive Burning Star, Illinois No. 6 coal.

FIG. 4
COMPARISON OF CONVERSION TO SOLUBLES
FOR ILLINOIS NO. 6 COAL AND A LOW VOLATILE COAL

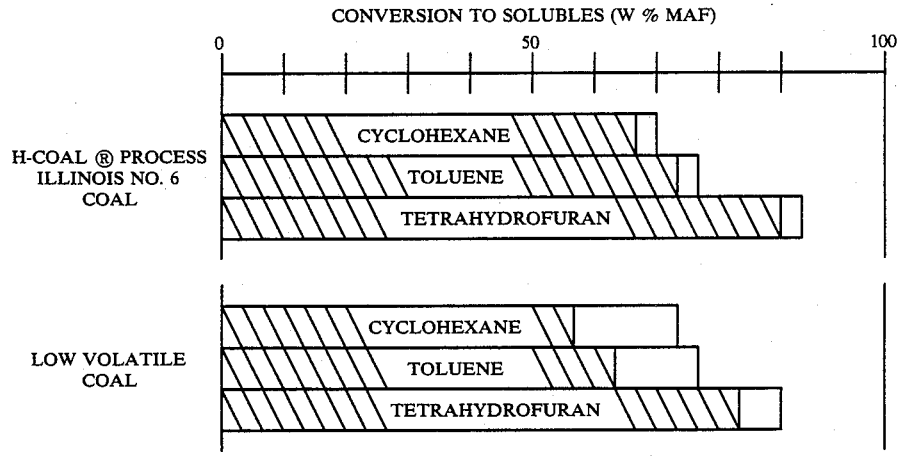

-continued

FIG. 4
COMPARISON OF CONVERSION TO SOLUBLES
FOR ILLINOIS NO. 6 COAL AND A LOW VOLATILE COAL

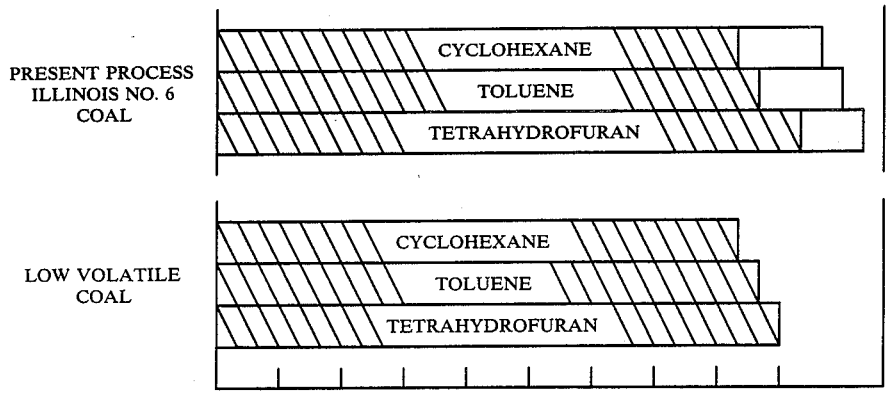

EXAMPLE 6

Present, H-Coal ®, and Thermal/Catalytic Processes

A series of runs were made to show the effectiveness of the present process in the conversion of a high rank, medium volatile bituminous, high ash coal. The present process was compared to a conventional single stage H-Coal ® process and to a two-stage thermal/catalytic process in small batch runs for raw and cleaned coals. The operating conditions for the different processes were as follows:

| | Processes | | |
|---|---|---|---|
| Conditions | H-Coal ® | Thermal/ Catalytic | Present |
| 1st Stage Temperature, °F. | | 550 | 550 |
| 1st Stage Reaction Time, Min. | | 30 | 30 |
| 1st Stage Pressure, psi | | 2000 | 2000 |
| 2nd Stage Temperature, °F. | 850 | 850 | 800 |

-continued

| | Processes | | |
|---|---|---|---|
| Conditions | H-Coal ® | Thermal/ Catalytic | Present |
| 2nd Stage Reaction Time, Min | 30 | 30 | 30 |
| 2nd Stage Pressure, psi | 2250 | 2250 | 2000 |

Figure 5:
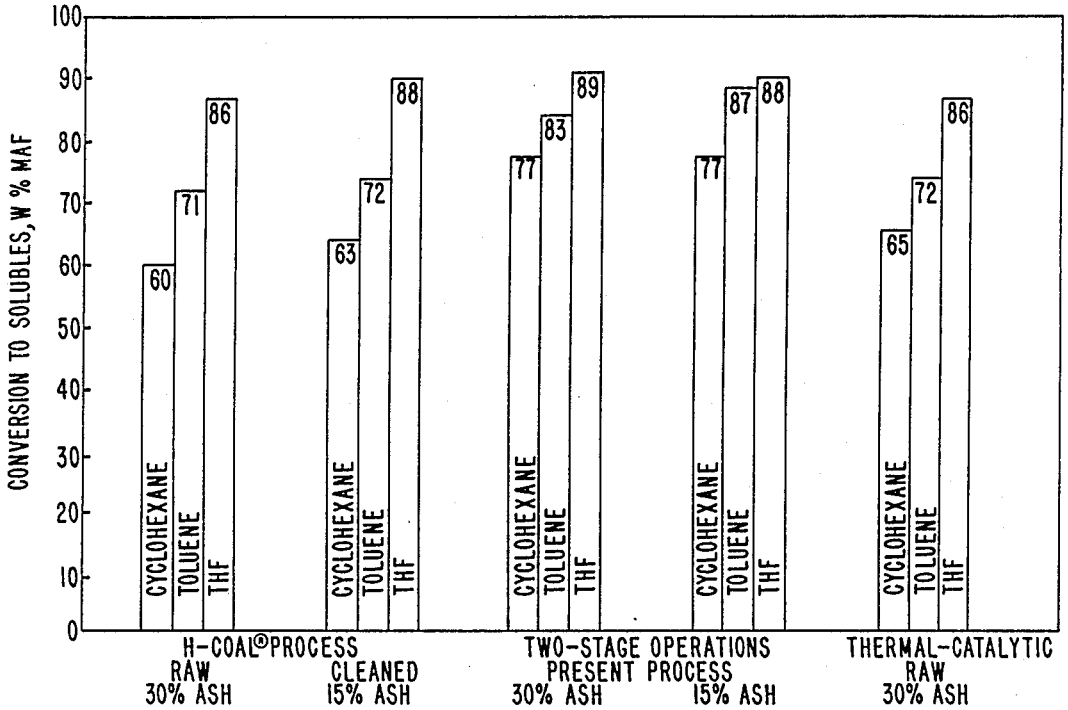

The results of the various runs are illustrated and set forth below in FIG. 5. The illustrated results of FIG. 5, show that on an ash free basis, the present process yields higher conversions to cyclohexane, toluene and tetrahydrofuran (THF) solubles than does the H-Coal ® process or the thermal/catalytic process. For this coal a 17% increase in cyclohexane solubles, a 12% increase in toluene solubles and a 1 to 3% increase in the THF solubles, are observed for the present process over the H-Coal ® process. Thus, the present process is effective in converting a high rank, medium volatile bituminous coal to solubles and hydrocarbon liquid products.

FIG. 5
COMPARISON OF CONVERSIONS TO SOLUBLES
FOR HIGH RANK, HIGH ASH COAL IN VARIOUS PROCESSES

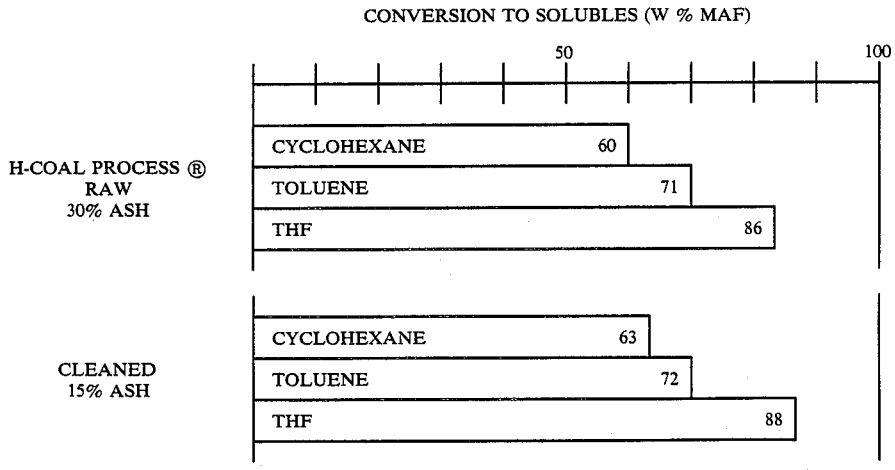

-continued

FIG. 5

COMPARISON OF CONVERSIONS TO SOLUBLES FOR HIGH RANK, HIGH ASH COAL IN VARIOUS PROCESSES

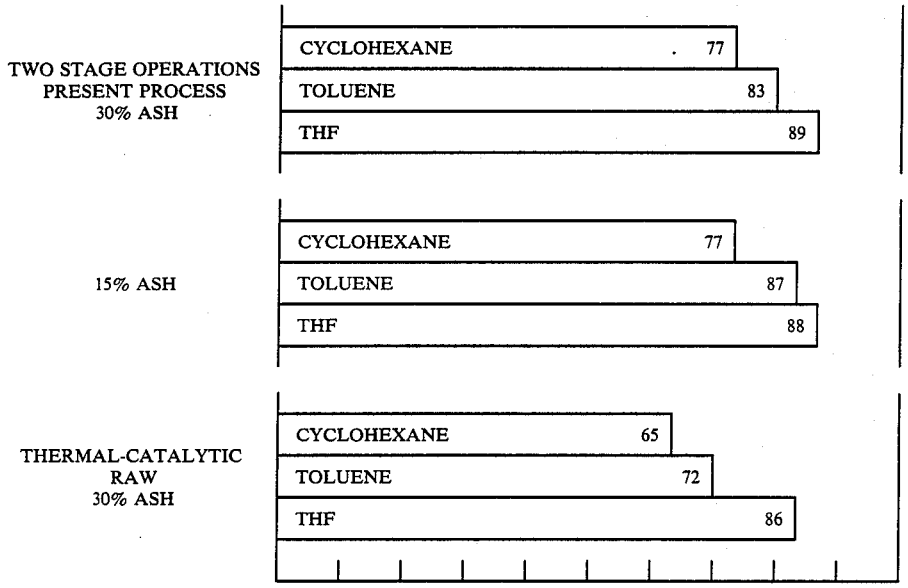

*THF - Tetrahydrofuran

EXAMPLE 7

Present, One Stage Thermal, H-Coal ®; Thermal/Thermal; and Thermal/Catalytic Processes A series of runs were made to show the effectiveness of the present process in the conversion of a highly unreactive, Western Canadian sub-bituminous coal. The series of runs compared the effectiveness of the present process with (1) one-stage thermal (2) H-Coal ®, (3) two-stage thermal/thermal and (4) two-stage thermal/-catalytic processes. In comparing these processes small batch tests were conducted, employing a heavy petroleum resid as a solvent for the coal.

The operating conditions for the different processes were as follows:

| | Processes | | | | |
|---|---|---|---|---|---|
| Conditions | Thermal | H-Coal ® | Thermal/ Thermal | Thermal/ Catalytic | Present |
| 1st Stage Temperature, °F. | | | 550 | 550 | 550 |
| 1st Stage Reaction Time, Min | | | 30 | 30 | 30 |
| 1st Stage $H_2$ Pressure, psig | | | 2000 | 2000 | 2000 |
| 2nd Stage Temperature, °F. | 850 | 850 | 800 | 800 | 800 |
| 2nd Stage Reaction Time, Min | 30 | 30 | 30 | 30 | 30 |
| 2nd Stage $H_2$ Pressure, psig | 2000 | 2250 | 2000 | 2000 | 2000 |

Figure 6:
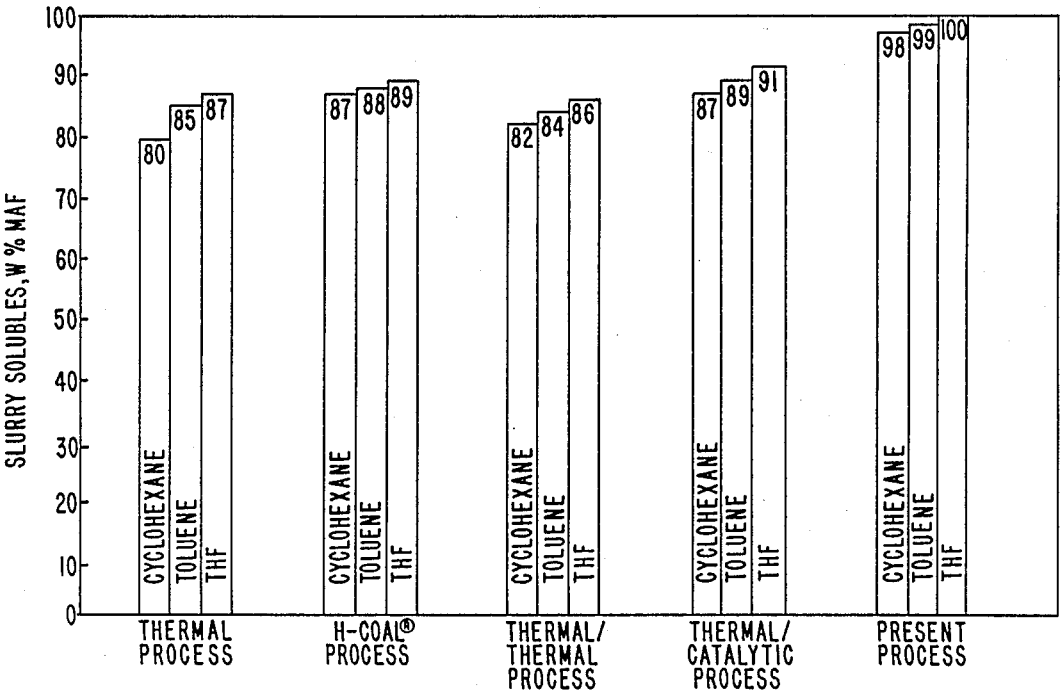
FIG. 6 is a chart showing comparative performance of the present process compared to other known processes for subbituminous coal mixed with heavy petroleum resid solvent.

The results of the comparative tests as illustrated below in FIG. 6, are based on a total slurry solubles of solubility on a M.A.F. basis. The results of the present process run show an increase of slurry 11% cyclohexane solubles, 11% toluene solubles and 11% tetrahydrofuran solubles over those produced by the H-Coal ® process. Also, the results show that for the present process, 100% tetrahydrofuran solubility is obtained. This indicates that all the coal is convertible to tetrahydrofuran solubles in the present process, but is not convertible in any other test mode shown. Also, a higher conversion to cyclohexane and toluene solubles were obtained for the present process than for any other process mode.

FIG. 6
CONVERSION TO SOLUBLES OF AN UNREACTIVE COAL WITH A HEAVY PETROLEUM RESID

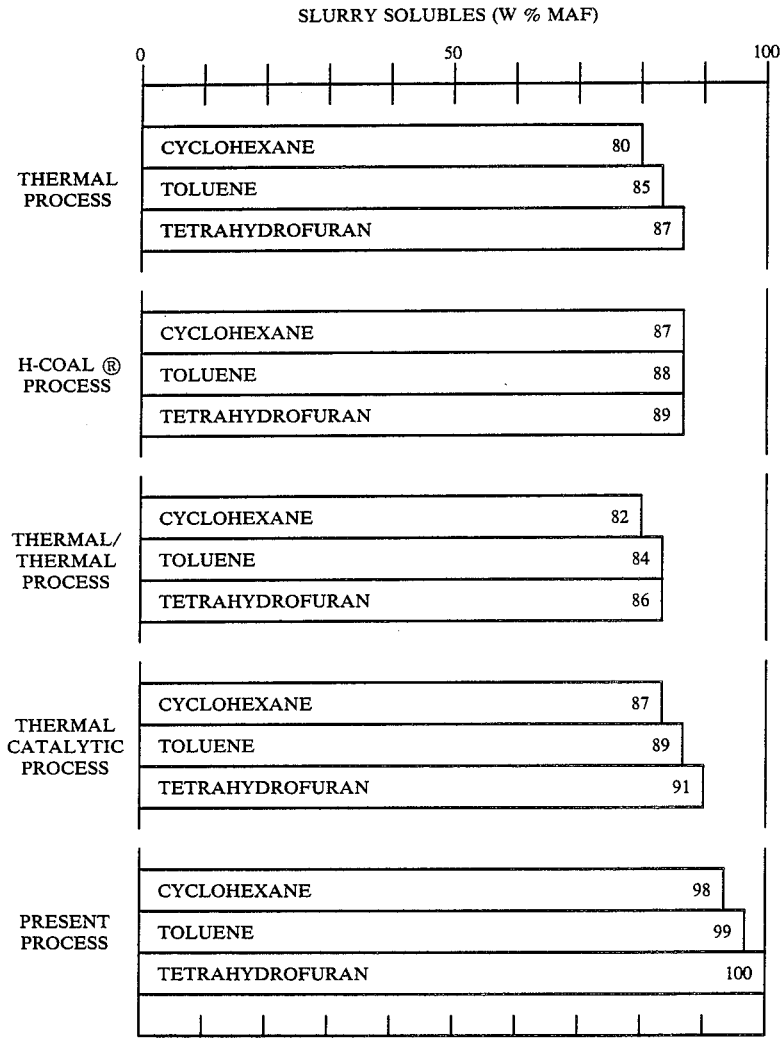

We claim:

1. A continuous two reactor stage coal conversion process for catalytic hydrogenation of coal particles and subsequent liquefaction thereof for producing coal-derived hydro-carbon liquid and gas products, said process comprising:

(a) mixing solid coal particles having particle size ranging from about 20 mesh to about 400 mesh (U.S. Sieve Series) with hydrocarbon liquid solvent in a solvent/coal weight ratio at least sufficient to provide a flowable coal/oil slurry feed of said solid coal particles, a substantial portion of said hydrocarbon solvent having a normal boiling point ranging from about 400° F. to about 1100° F.;

(b) passing said coal/oil slurry and hydrogen upwardly through a first reaction zone containing hydrocarbon solvent liquid which is partly generated from the coal and substantially hydrogenated therein, said first reaction zone containing a catalytic ebullated bed of particulate solid hydrogenation catalyst maintained at a temperature ranging from about 550° F. to about 650° F., and having a hydrogen partial pressure of 100 to 2000 psig for a residence time between about 5 minutes and about 90 minutes to substantially hydrogenate said solvent oil and said solid undissolved coal particles simultaneously in said coal/oil slurry by transfer of gaseous hydrogen to the solvent oil and coal particles without substantial liquefaction of the coal, said catalyst containing an active non-alkali metal or metal compound selected from the group consisting of Co/Mo, Ni/Mo, Li, Sn promoted Co/Mo, W promoted Co/Mo, NiS, CoS, MoS, FeS, $FeS_2$, LiH, $MgH_2$ and mixtures thereof supported on a porous substrate material, said first catalytic ebullated bed reaction zone being back mixed by recycled liquid slurry within the reaction zone;

(c) withdrawing said coal/oil slurry effluent containing said hydrogenated coal particles from said first reaction zone and passing said coal/oil slurry through a second reaction zone containing a catalytic ebullated bed of particulate hydrogenation catalyst which is maintained at a temperature between about 700° F. and about 850° F., and a hydrogen partial pressure of 100 to 2000 psig for a residence time of about 1 to 90 minutes to liquefy and convert said hydrogenated coal particles to gas and liquid fractions, said catalyst containing an active non-alkali metal or metal compound supported on a porous substrate material, said second catalytic ebullated bed reaction zone being back mixed by recycled liquid within the reaction zone;

(d) passing said gas and liquid fractions from said second reaction zone to a gas-liquid-solids separation zone, from which separation zone a coal-derived hydrocarbon liquid stream containing a reduced solids concentration is recycled directly without further hydrogenation to said coal slurrying step to provide at least part of the hydrocarbon solvent liquid for said coal/oil slurry feed, a recovered hydrogen gas stream is recycled to said first reaction zone to provide the hydrogen partial pressure in the first reaction zone, and a liquid stream is removed containing an increased concentration of insoluble materials and ash; and (e) recovering from said separation zone hydrocarbon liquid distillate and gaseous hydrocarbon products, whereby the substantial catalytic hydrogenation of the coal particles in the first reaction zone before catalytic liquefaction in the second reaction zone provides increased yields of C4-975° F. fraction hydrocarbon liquid products, with the yield of cyclohexane soluble product material being about 60–90 W% of the coal feed.

2. A process according to claim 1, wherein the catalytic ebullated bed in the second reaction zone comprises a particulate solid porous catalyst containing an active metal oxide selected from the group consisting of Co/Mo, Ni/Mo, Li, Sn promoted Co/Mo, W promoted Co/Mo, NiS, CoS, MoS, FeS, $FeS_2$, LiH, $MgH_2$ and mixtures thereof supported on a porous substrate material of alumina, silica or mixtures thereof.

3. A process according to claim 1, wherein the amount of hydrogen utilized in the first reaction zone ranges from about 2.0 to about 4.0 W% of the dry coal feed.

4. A process according to claim 1, wherein the hydrocarbon liquid distillate products include naphtha, gasoline, and diesel fuel.

5. A process according to claim 1, wherein the residence time of the material in said first reaction zone ranges from about 10 to about 30 minutes, the temperature of the second reaction zone is about 800° F. to 825° F. and the residence time of the material therein ranges from about 10 to about 30 minutes.

6. A process according to claim 1, wherein the hydrocarbon solvent utlized in the coal/oil slurry is selected from the group consisting of petroleum-derived residual oil, shale oil, tar sand bitumen, and an oil derived from coal other than that processed herein.

7. A process according to claim 1, wherein the total pressure maintained in said first reaction zone ranges from about 100 to about 4000 psig.

8. A process according to claim 1, wherein the total pressure maintained in said second reaction zone ranges from about 100 to about 4000 psig.

9. A process according to claim 1, wherein the coal of said coal/oil slurry feed is selected from the group consisting of bituminous and subbitiminous coals, lignite, and peat.

10. A process according to claim 1, wherein said coal particles have a particle size ranging from about 70 mesh to about 100 mesh (U.S. Sieve Series).

11. A continuous two reactor stage coal conversion process for catalytic hydrogenation of coal particles and subsequent liquefaction thereof for producing coal-derived hydrocarbon liquid and gas products, said process comprising:

(a) mixing solid coal particles having particle size ranging from about 20 mesh to about 400 mesh (U.S. Sieve Series with a coal-derived hydrocarbon solvent liquid in a solvent/coal weight ratio at leastsufficient to provide a flowable coal/oil slurry feed of said solid coal particles, a substantial portion of said coal-derived solvent having a normal boiling point ranging from about 400° F. to about 1100° F. and at least about 50 W% having a normal boiling point above about 975° F.;

(b) passing said coal/oil slurry and hydrogen upwardly through a first reaction zone containing coal-derived hydrocarbon solvent liquid which is partly generated from the coal and substantially hydrogenated therein, said first reaction zone containing a catalytic ebullated bed of particulate solid hydrogenaton catalyst maintained at temperature ranging from about 550° F. to about 650° F., and a hydrogen partial pressure of 100 to 2000 psig for a residence time of about 5 to 90 minutes to substantially hydrogenate the solvent oil and undissolved coal particles simultaneously in said coal/oil slurry by hydrogen transfer to the solvent oil and coal particles without substantial liquefaction of the coal, so as to achieve an equilibrium hydrogen content in the coal particle matrix, said catalyst containing an active non-alkali metal or metal compound selected from the group consisting of CO/Mo, Ni/Mo, Li, Sn promoted Co/Mo, W promoted Co/Mo, NiS, CoS, MoS, FeS, $FeS_2$, LiH, $MgH_2$ and mixtures thereof supported on a porous substrate material comprising alumina, silica or mixtures thereof, said first catalytic ebullated bed reaction zone being back mixed by recycled liquid slurry within the reaction zone;

(c) withdrawing said coal/oil slurry effluent containing said hydrogenated coal particles from said first reaction zone and passing said coal/oil slurry through a second reaction zone containing a catalytic ebullated bed of particulate solid hydrogenation catalyst which is maintained at a temperature between about 700° F. and about 850° F., a hydrogen partial pressure of 100 to 2000 psig and a residence time of about 1 to 90 minutes to liquefy and convert said hydrogenated coal particles to gas and liquid fractions, said catalyst containing an active non-alkali metal or metal compound selected from the group consisting of Co/Mo, Ni/Mo, Li, Sn promoted Co/Mo, W promoted Co/Mo, NiS, CoS, Mos, FeS, $FeS_2$ and mixtures thereof, supported on a porous substrate material of alumina, silica, or mixtures thereof, said second catalytic ebullated bed reaction zone being back mixed by recycled liquid within the reaction zone;

(d) passing said gas and liquid fractions from said second reaction zone to a gas-liquids-solids separation zone, from which separation zone a coal-derived hydrocarbon liquid stream containing a reduced solids concentration is recycled directly without further hydrogenation to said coal slurrying step to provide at least part of the coal-derived liquid for said coal/oil slurry feed, a recovered hydrogen gas stream is recycled to said first reaction zone to provide the hydrogen partial pressure in the first reaction zone, and a liquid stream is removed containing an increased concentration of insoluble materials and ash; and (e) recovering from said separation zone hydrocarbon liquid distillate and gaseous hydrocarbon products, whereby the substantial catalytic hydrogenation of the coal particles in the first catalytic reaction zone before catalytic liquefaction in the second catalytic reaction zone provides increased yields of C4-975° F. fraction hydrocarbon liquid products, with the yield of cyclohexane soluble product materials being about 60–90 W% of the coal feed.

12. A coal conversion process according to claim 11, wherein the hydrocarbon liquid distillate products include naphtha, gasoline, and diesel fuel.

13. A coal conversion process according to claim 1, wherein said hydrocarbon liquid solvent is entirely coal-derived from within the process.

14. A coal conversion process according to claim 1, where the recycled liquid from said second stage reaction zone is passed through a heat exchange step for heating the liquid and maintaining the temperature in the second stage reaction zone.

15. A coal conversion process according to claim 1, wherein said gas-liquid-solids separation zone includes a first separation-purification system from which said hydrogen gas stream is obtained, and a second separation-purification system from which said liquid stream containing a reduced solids concentration and said liquid distillate products are obtained.

16. A catalytic coal conversion process according to claim 1, wherein the catalyst in said first and second stage reaction zones is nickel-molybdate or cobalt-molybdate on alumina support material.

17. A continuous two reactor stage coal conversion process for catalytic hydrogenation of coal particles and subsequent liquefaction thereof for producing coal-derived hydrocarbon liquid and gas products, said process comprising:

(a) mixing solid coal particles having particle size ranging from about 20 mesh to about 400 mesh (U.S. Sieve Series) with a coal-derived hydrocarbon solvent liquid in a solvent/coal weight ratio ranging from about 8/1 to about 1.5/1 to provide a flowable coal/oil slurry feed of said solid coal particles, a substantial portion of said coal-derived solvent having a normal boiling point ranging from about 400° F. to about 1100° F. and at least 50 W% having a normal boiling point above about 975° F.;

(b) passing said coal/oil slurry and hydrogen upwardly through a first reaction zone containing coal-derived hydrocarbon solvent liquid which is partly generated from the coal and substantially hydrogenated therein, said first reaction zone containing a catalytic ebullated bed of particulate solid hydrogenation catalyst maintained at temperature ranging from about 550° F. to about 650° F., and a hydrogen partial pressure of 100 to 2000 psig for a residence time of about 5 to 90 minutes to substantially hydrogenate the solvent oil and undissolved coal particles simultaneously in said coal/oil slurry, by hydrogen transfer to the solvent oil and coal particles without substantial liquiefaction of the coal so as to achieve an equilibrium hydrogen content in the coal particle matrix, with the amount of hydrogen utilized therein being 2–4 W% of the dry coal feed, said catalyst containing an active non-alkali metal compound of cobalt-molybdate or nickel-molybdate supported on a porous substrate material of alumina, silica or mixtures thereof, said first catalytic ebullated bed reaction zone being back mixed by recycled liquid slurry within the reaction zone;

(c) withdrawing said coal/oil slurry effluent containing said hydrogenated coal particles from said first reaction zone and passing said coal/oil slurry through a second reaction zone containing a catalytic ebullated bed of particulate solid hydrogenation catalyst maintained at a temperature between about 700° F. and about 850° F., a hydrogen partial pressure of 100 to 2000 psig and a residence time of 1–90 minutes to liquefy and convert the hydrogenated coal particles to gas and liquid fractions, said catalyst containing an active non-alkali metal compound of cobalt-molybdate or nickel-molybdate supported on a porous substrate material of alumina, silica or mixtures thereof, said second catalytic ebullated bed reaction zone being back mixed by recycled liquid within the reaction zone;

(d) passing said gas and liquid fractions from said second reaction zone to a gas-liquid-solids separation zone, from which separation zone a coal-derived hydrocarbon liquid stream containing a reduced solids concentration is recycled directly without further hydrogenation to said coal slurrying step to provide the coal-derived liquid for said coal/oil slurry feed, a recovered hydrogen gas stream is recycled to said first reaction zone to provide the hydrogen partial pressure in the first reaction zone, and a liquid stream is removed containing an increased concentration of insoluble materials and ash; and (e) recovering from said separation zone hydrocarbon liquid distillate and gaseous hydrocarbon products including naphtha, gasoline and diesel fuel oil, whereby the substantial catalytic hydrogenation of the coal particles in the first catalytic reaction zone before catalytic liquefaction in the second catalytic reaction zone provides increased yields of C4-975° F. fraction hydrocarbon liquid products, with the yield of cyclohexane soluble product materials exceeding about 67 W% of the coal feed.

* * * * *

UNITED STATES PATENT AND TRADEMARK OFFICE

CERTIFICATE OF CORRECTION

PATENT NO. : 4,879,021

DATED : November 7, 1989

INVENTOR(S) : Edwin J. Hippo, et al

It is certified that error appears in the above-identified patent and that said Letters Patent is hereby corrected as shown below:

Column 1, line 13, after "coal" insert --hydrogenation and--

Column 1, line 15, delete "hydrogenation and"

Column 1, line 17, "particulates" should read --particles--

Column 1, line 19, "particles" should read --particulate--

Column 1, line 49, delete "particle"

Column 1, line 50, "particle" should read --particles--

Column 1, line 54, after "light" insert --hydrocarbon--;
after "In" delete --hydrocarbon--

Column 2, line 14, after "and" insert --gaseous--

Column 3, line 6, after "hydrogenated" insert --coal--

Column 3, line 7, after "useful" insert --fuel--

Column 3, line 15, delete "hydrocar-"

Column 3, line 16, delete "bon";after "to" insert
--hydrocarbon--

Column 3, line 27, after "pressure" insert --conditions--

UNITED STATES PATENT AND TRADEMARK OFFICE

CERTIFICATE OF CORRECTION

PATENT NO. : 4,879,021

DATED : November 7, 1989

INVENTOR(S) : Edwin J. Hippo, et al

It is certified that error appears in the above-identified patent and that said Letters Patent is hereby corrected as shown below:

Column 4, line 16, after "sands" delete the comma; after "bitumen" insert a comma ","

Column 4, line 17, after "The" insert --hydrocarbon--

Column 4, line 20, "Where" should read --where--

Column 4, line 26, replace "into" with --and--

Column 4, line 42, after "conventional" insert --single stage--

Column 5, line 12, delete "and"

Column 8, line 23, "yield" should read --Yield/--

Column 8, line 64, "fractions" should read --fraction--

Column 9, lines 27-28, replace "product fractions" with --and--

Column 9, line 54, after "F" insert slash --/--

Column 10, line 6, "AF" should be --MAF--

Column 10, line 27, replace "low" with --lower boiling point--

UNITED STATES PATENT AND TRADEMARK OFFICE

CERTIFICATE OF CORRECTION

PATENT NO. : 4,879,021

DATED : November 7, 1989

INVENTOR(S) : Edwin J. Hippo, et al

It is certified that error appears in the above-identified patent and that said Letters Patent is hereby corrected as shown below:

Column 10, line 63, after "yields" insert --obtained--

Column 10, line 64, after "test" insert --made at substantially the same reaction conditions--

Column 11, line 65, after "of" insert --hydrogen--

Column 12, line 1, delete "for"

Column 13 and 14, lines 1-28, delete this Fig. 3 drawing

Column 18, line 56, delete "solubles of"

Column 18, line 58, after "slurry" insert --solubles of--

Signed and Sealed this

Twenty-seventh Day of November, 1990

*Attest:*

HARRY F. MANBECK, JR.

*Attesting Officer*

*Commissioner of Patents and Trademarks*